US007467731B2

(12) United States Patent
Shraiber

(10) Patent No.: US 7,467,731 B2
(45) Date of Patent: Dec. 23, 2008

(54) HOLDER CONSTRUCTION PARTICULARLY USEFUL FOR HOLDING AND DISPENSING PRESSURE-FLOWABLE PRODUCTS, SUCH AS ICE-CREAM OR OTHER RELATIVELY SOFT FOODS

(76) Inventor: Mickey Shraiber, 130 Alexander Zaid Street, 26301 Kiryat-Haim (IL)

( * ) Notice: Subject to any disclaimer, the term of this patent is extended or adjusted under 35 U.S.C. 154(b) by 150 days.

(21) Appl. No.: 11/038,659

(22) Filed: Jan. 21, 2005

(65) Prior Publication Data

US 2005/0178796 A1 Aug. 18, 2005

Related U.S. Application Data

(63) Continuation-in-part of application No. PCT/IL2004/000030, filed on Jan. 13, 2004.

(30) Foreign Application Priority Data

Jan. 14, 2003 (IL) ..... 153940

(51) Int. Cl.
*B05B 11/00* (2006.01)
*B65D 88/54* (2006.01)
*B67D 5/42* (2006.01)

(52) U.S. Cl. ..... 222/78; 222/326; 222/390

(58) Field of Classification Search ..... 222/78, 222/326, 327, 390, 575, 405, 325, 192; 426/115
See application file for complete search history.

(56) References Cited

U.S. PATENT DOCUMENTS 691,266 A 1/1902 Hill
2,018,158 A * 10/1935 Violette ..... 401/174
2,751,118 A 6/1956 Soule
3,105,612 A 10/1963 Krasnoff et al.
3,178,060 A * 4/1965 Bossack ..... 222/78
3,275,195 A * 9/1966 Reinstra ..... 222/102
3,299,891 A * 1/1967 Smeton ..... 604/232
3,418,059 A 12/1968 Robe
4,277,194 A * 7/1981 Smith ..... 401/173
D314,340 S * 2/1991 Waugh ..... D9/455
D315,083 S 3/1991 Anderson et al.
5,115,948 A 5/1992 Johnson
5,437,513 A 8/1995 Favre
5,769,553 A * 6/1998 Chaudhri et al. ..... 401/195
5,839,622 A 11/1998 Bicknell et al.
5,871,124 A * 2/1999 Wilkinson ..... 222/192
6,086,276 A 7/2000 Gueret
6,368,646 B1 * 4/2002 Monow et al. ..... 426/115
6,499,900 B1 12/2002 Brozell
6,988,638 B2 * 1/2006 Zak ..... 222/78

FOREIGN PATENT DOCUMENTS

WO WO 2006/077574 7/2006

* cited by examiner

*Primary Examiner*—Kevin P Shaver
*Assistant Examiner*—Melvin A Cartagena

(57) ABSTRACT

A holder for enabling a user to hold and to dispense a pressure-flowable product, such as ice-cream or other relatively soft food product. The holder includes a housing having an internal compartment for the pressure-flowable product. One end of the housing is formed with one or more dispensing openings for dispensing the product. The holder is constructed such that the volume of the compartment may be progressively decreased by the user to progressively force the product within the compartment through the dispensing opening of the housing for consumption by the user. In many described preferred embodiments, the housing is shaped like a toy figure making the holder particularly attractive to children.

4 Claims, 13 Drawing Sheets

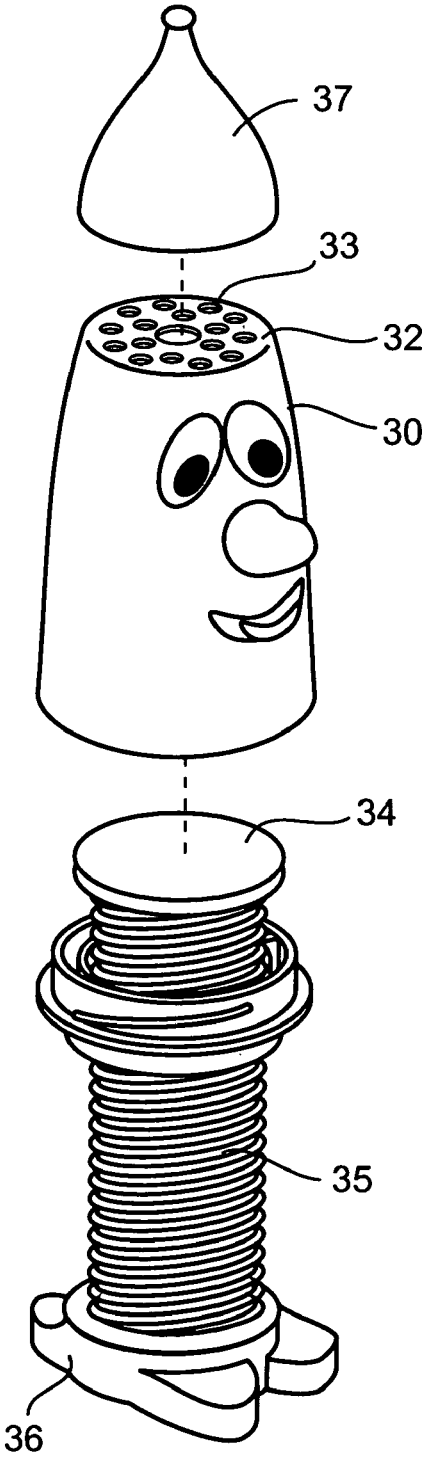
Fig. 7
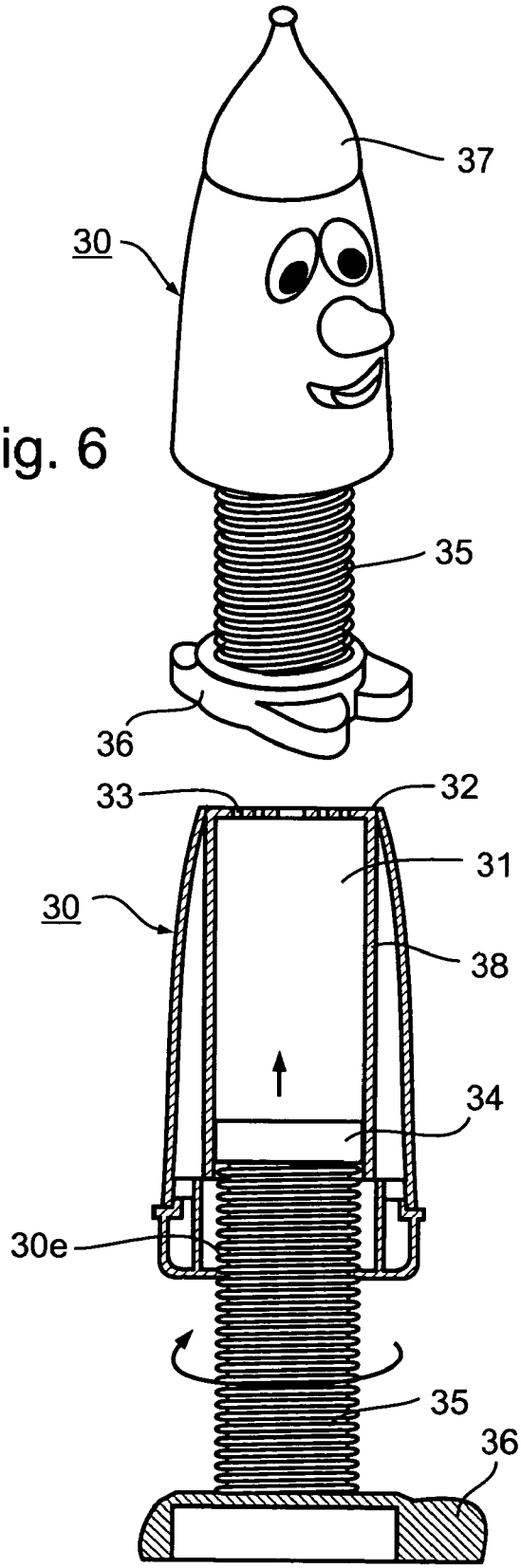
Fig. 6
Fig. 8

HOLDER CONSTRUCTION PARTICULARLY USEFUL FOR HOLDING AND DISPENSING PRESSURE-FLOWABLE PRODUCTS, SUCH AS ICE-CREAM OR OTHER RELATIVELY SOFT FOODS

RELATED APPLICATIONS

The present application is a continuation-in-part of the U.S. National Phase Application based on International Application No. PCT/IL2004/000030 having an International filing date of 13 Jan. 2004, which claims priority from Israel Patent Application No. 153940, filed 14 Jan. 2003. The contents of the above-cited International and Israel Patent Applications are expressly incorporated herein by reference.

FIELD AND BACKGROUND OF THE PRESENT INVENTION

The present invention relates to holders for holding various types of products, and particularly to holders for holding and dispensing ice-cream or other relatively soft food products.

As brought out in the above-cited International Application No. PCT/IL2004/000030, there is a need for a food product holder constructed so as to enable a user to hold and dispense ice-cream, or other relatively soft food products (such as yogurt, pudding, etc,) while consuming the food product. Such a food product holder would be particularly useful for children to enable the child to conveniently hold the food product, (e.g., while seated in a motor vehicle, or while walking) and to conveniently dispense the food product from the holder while the food product is consumed by the child.

OBJECTS AND BRIEF SUMMARY OF THE PRESENT INVENTION

An object of the present invention is to provide a holder for enabling a user to hold and to dispense a pressure-flowable product in a convenient manner. Another object of the invention is to provide a holder which is particularly attractive to children for dispensing various types of products to children.

According to one aspect of the present invention, there is provided a holder for enabling a user to hold and to dispense a pressure-flowable product, comprising: a housing having an internal compartment for the pressure-flowable product; one end of the housing being closed by an end wall formed with at least one dispensing opening for dispensing the pressure-flowable product; the holder being constructed such that the volume of the compartment may be progressively decreased by the user to progressively force the pressure-flowable product within the compartment through the dispensing opening in the end wall of the housing.

According to another aspect of the present invention, there is provided a holder for holding for enabling a user to hold and to dispense a pressure-flowable product, comprising: a housing having an internal compartment for the pressure-flowable product; one end of the housing being closed by an end wall formed with at least one dispensing opening for dispensing the pressure-flowable product; the housing being shaped like a toy figure so as to be attractive to children, and being constructed such that the volume of the compartment may be progressively decreased by the user to progressively force the pressure-flowable products within the compartment through the dispensing opening in the end wall of the housing.

A number of embodiments of the invention are described below for purposes of example. In some described preferred embodiments, the pressure-flowable product to be dispensed, e.g., ice-cream, yogurt, pudding, liquid medication, or the like, is pre-filled in a container or cartridge before introduction into the housing, such that when the container or cartridge is depleted, it may be conveniently removed and replaced by another pre-filled container or cartridge.

In several described preferred embodiments, the food product holder includes a rotatable screw and plunger and a rack-and pinion mechanism for rotating the screw.

In another described preferred embodiment, the housing includes an inflatable body which is progressively inflatable to progressively decrease the volume of the food compartment. In further described embodiments, the inner surface of the housing defines the food compartment, and the housing is deformable by hand compression for progressively reducing the volume of the compartment.

Further features and advantages of the invention will be apparent from the description below.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIGS. 6-8 are views, corresponding to those of FIGS. 3-5, respectively, illustrating a modification in the construction of the food product holder of FIGS. 3-5;

DESCRIPTION OF PREFERRED EMBODIMENTS

As indicated earlier, the present invention relates to a holder for enabling a user, such as a child, to hold and to dispense ice-cream or other relatively soft food product or another pressure-flowable material such as a liquid medication, while consuming the dispensed food product. Such a holder includes a housing having an internal compartment for the product to be dispensed. One end of the housing is formed with at least one dispensing opening, preferably a plurality of such openings, for dispensing the product. The holder is constructed such that the volume of the compartment may be progressively decreased by the user (e.g., child) to progressively force the pressure-flowable product within the compartment through the dispensing opening of the housing for consumption.

The drawings illustrate a number of such constructions of holders particularly useful for ice-cream or other relatively soft food products.

Figure 1:
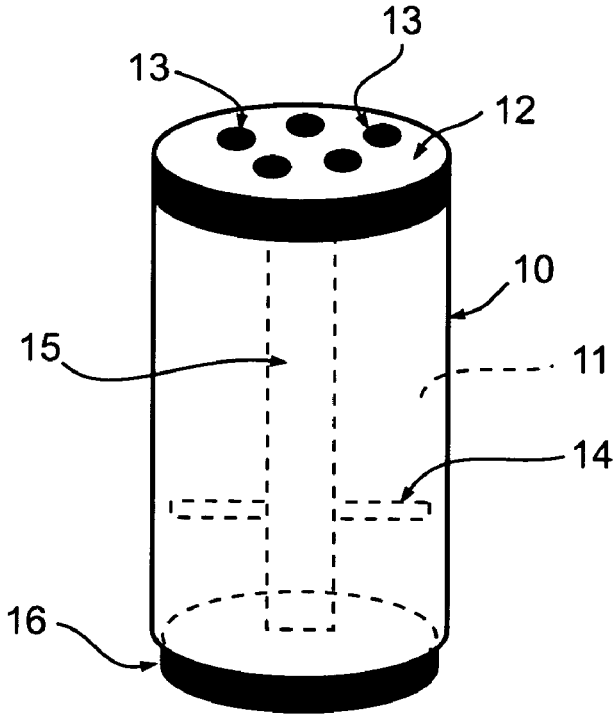
FIG. 1 illustrates one form of food product holder constructed in accordance with the present invention as described in the above cited International Application.
Figure 2:
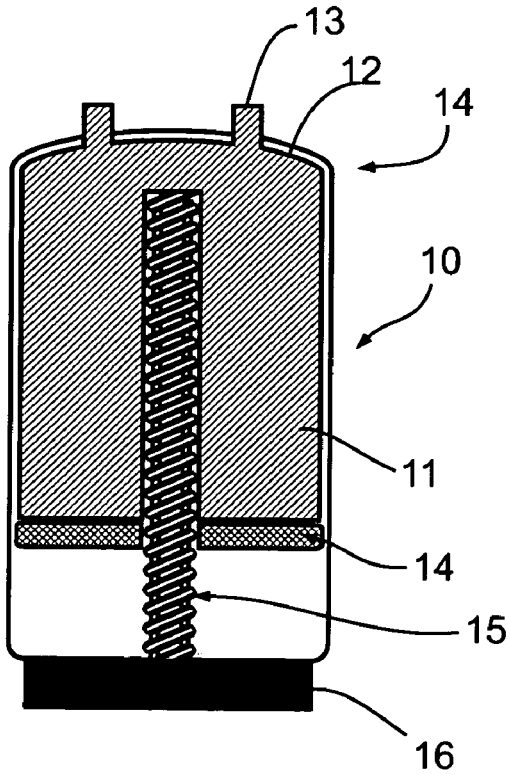
FIG. 2 is a sectional view illustrating the food product holder of FIG. 1.

The food product holder illustrated in FIGS. 1 and 2 includes a housing 10 of an elongated cylindrical configuration defining an internal food compartment 11 for containing ice-cream or other relatively soft food product. One end of housing 10 is closed by an end wall 12 formed with a plurality of dispensing openings 13 for dispensing the food product. End wall 12 thus defines one end of the food compartment 11. The opposite end of the food compartment is defined by a plunger 14 extending transversely of housing 10 and threadeadly received on a screw 15 extending axially of the housing. Screw 15 is fixed to a disc 16 exposed externally of housing 10, such that it is readily accessible to the user holding the food product.

It will thus be seen that when compartment 11 of the food product holder illustrated in FIGS. 1 and 2 is filled with the food product, e.g., ice-cream, plunger 14 would be at its lowermost position within housing 10. As the user consumes the food product within compartment 11, the user manually rotates disc 16, to rotate screw 15, and thereby to move plunger 14 axially within housing 10. This progressively decreases the volume of compartment 11 such as to force the ice-cream (or other food product) through dispensing openings 13 for consumption by the user. Thus, by rotating external disc 16, the user may raise plunger 14 so as to engage end wall 12, and thereby to force substantially the entire contents of compartment 11 through dispensing openings 13 for consumption.

The food product holder illustrated in FIGS. 1 and 2 may be constructed as a disposable article for one-time use. Alternatively, the holder can be constructed for multiple use. In such case disc 16 would be rotated in the opposite direction to lower plunger 14, and thereby to enable refilling of compartment 11, e.g., by opening end wall 12, or by forcing the food product through the dispensing openings 13.

Figure 4:
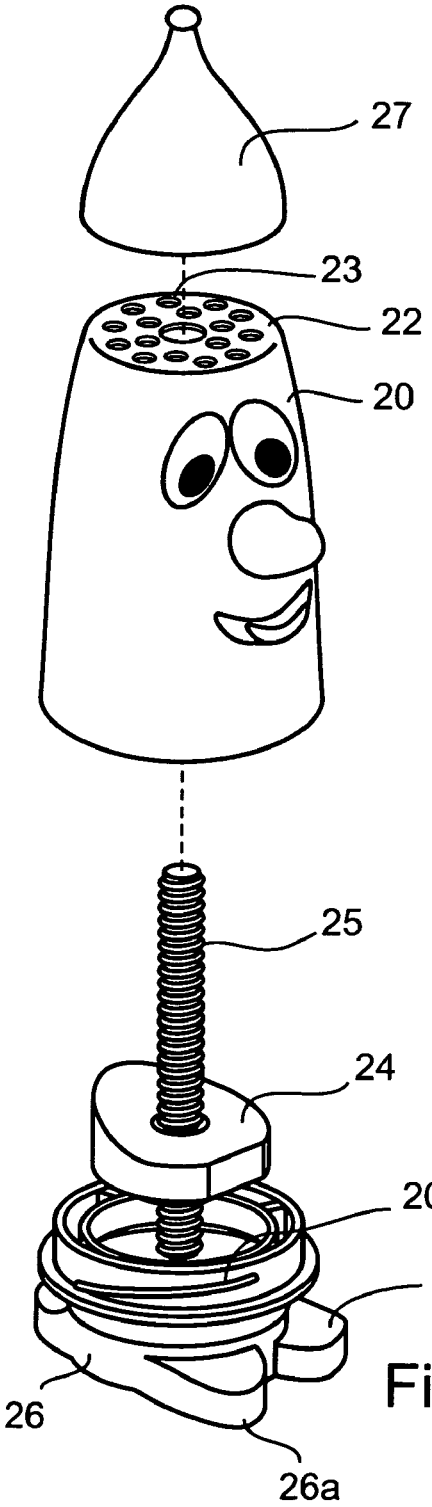
FIGS. 4 and 5 are exploded and sectional views, respectively, of the food product holder of FIG. 3.
Figure 3:
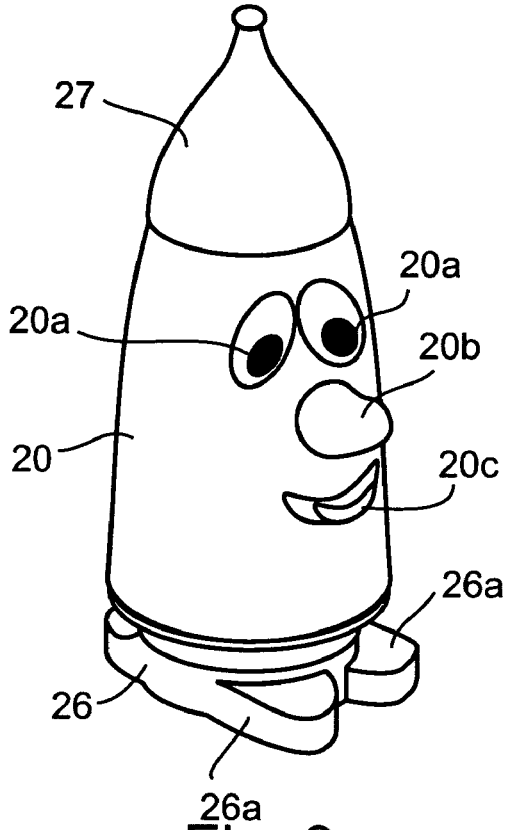
FIG. 3 illustrates a further food product holder constructed in accordance with the present invention.
Figure 5:
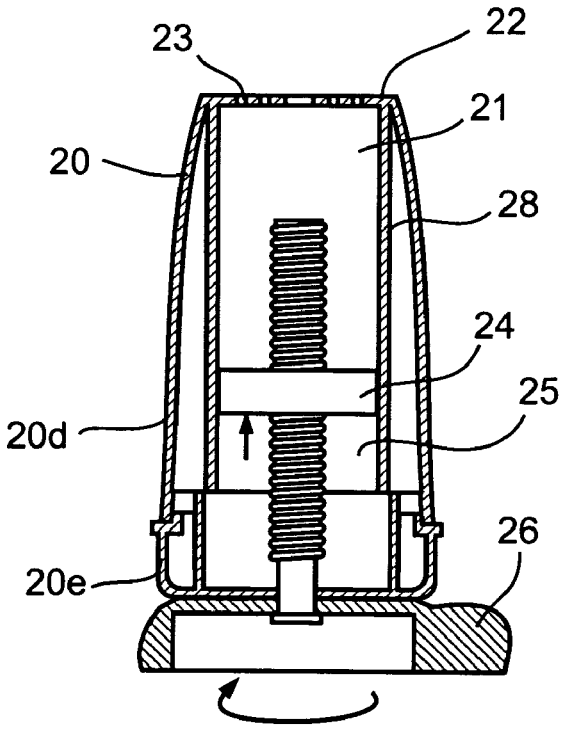

FIGS. 3-5 illustrate a food product holder constructed substantially as described above with respect to FIGS. 1 and 2, except that the housing, therein generally designated 20, is configured as a toy so as to be particularly attractive to children.

The food product holder illustrated in FIGS. 3-5 is otherwise constructed similar to that described above with respect to FIGS. 1 and 2. Thus, housing 20 defines an internal compartment 21 for containing the food product (not shown), which compartment is closed at one end by end wall 22 formed with a plurality of dispensing openings 23, and at the opposite end by a plunger 24 extending transversely of housing 20. Plunger 24 is threadedly received on a screw 25 extending axially of the housing. Screw 25 is secured at one end to a disc 26 extending externally of the housing so as to be readily accessible by the user, (e.g., child) for rotation in order to progressively reduce the volume of the food compartment 21, and thereby to progressively force the food product therein out through the dispensing openings 23 for consumption.

As indicated above, housing 20 in the food product holder illustrated in FIGS. 3-5 is shaped like a toy figure having a flat base permitting it to stably rest on a flat horizontal surface. In the embodiment illustrated in FIGS. 3-5, housing 20 is configured to simulate a face having a pair of eyes 20*a*, a nose 20*b* and a mouth 20*c*. The external disc 26 used for rotating screw 25 in order to progressively force the food product through dispensing openings 23 is shaped like feet, as shown at 26*a*, for stably supporting the housing on a flat horizontal surface.

The food product holder illustrated in FIGS. 3-5 further includes a cover 27 in the shape of a cap removably applied over end wall 22 to cover dispensing openings 23 during the time the holder is not actually used for dispensing the food product within it.

In the construction illustrated in FIGS. 3-5, compartment 21 for receiving the food product is defined by an inner housing 28 receivable within the outer housing 20. Thus, the outer housing 20, which is shaped like a toy figure, may be constructed for multiple use; whereas the inner housing 28 to contain the food product may be constructed as a disposable unit for one time use when the food product has been consumed. Preferably, the outer housing 20 for multiple use would also include screw 25 threadeadly receiving plunger 24, but the latter elements could also be included in the disposable unit including the inner housing 28.

As shown particularly in FIG. 4 plunger 24 is preferably of a non-circular configuration, in which case the inner housing 28 would be of a similar non-circular configuration. Such a construction prevents rotation of the plunger 24, upon rotation of screw 25, and thereby constrains the plunger to axial movement during the rotation of the screw.

Preferably, the outer housing 20 is made of two sections, as shown 20*d* and 20*e*, FIG. 5, conveniently attachable to each other, e.g., by inclined ribs 20*f*, FIG. 4.

FIGS. 6-8 illustrate a food product holder construction similar to that of FIGS. 3-5, also including an outer housing 30 defining an inner compartment 31 closed at one end by end wall 32 having dispensing openings 33, and enclosing a plunger 34 carried by a screw 35. As in FIGS. 3-5, screw 35 is rotatable by an external disc 36 to progressively advance the food product (e.g., ice-cream) within the inner housing container 38 through the dispensing openings 33.

In this case, however, plunger 34 is not threaded on screw 35, but rather is fixed to the upper end of the screw. For advancing the plunger 34 within the inner housing 38, the screw is threadedly received in the lower housing section 30*e*, such that rotation of the screw advances the screw, together with plunger 34, with respect to the food product within the inner housing 38. The construction illustrated in FIGS. 6-8 thus better lends itself for use with pre-filled containers 38 which can be introduced through the top of outer housing 30 and also removed through the top of the outer housing when the food product is depleted for replacement with another filled container.

FIGS. 9-12*c* illustrate a food product holder also similar to that of FIGS. 3-5, in that it also includes another housing 40 having an internal food compartment 41 closed at one end by an end wall 42 formed with dispensing openings 43. Food compartment 41 is closed at the opposite end by a plunger 44 movable on a rotatable screw 45 away from the base 46 to progressively feed the food product within an inner housing 48 through the dispensing openings 43 for consumption by the user. In this case, however, the screw 45 is rotated by a rack-and-pinion mechanism, generally designated 49.

Figure 11:
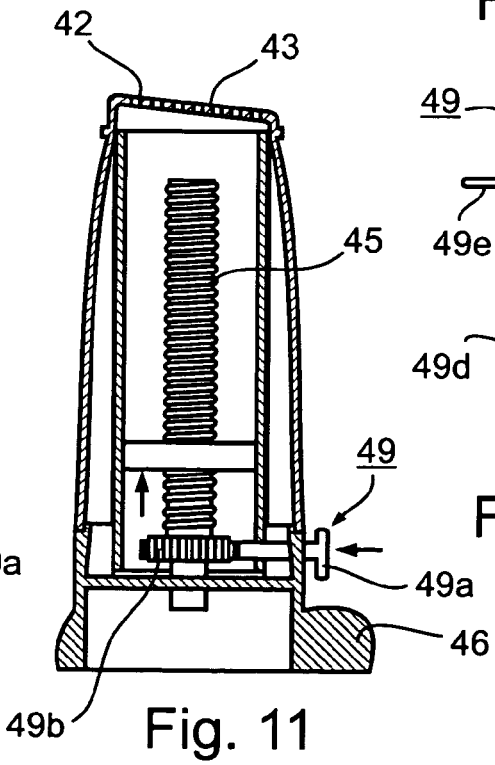
Figure 12A:
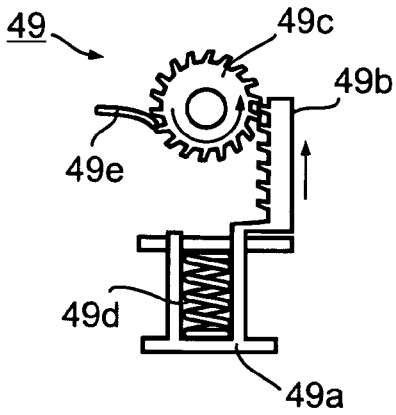
FIGS. 12*a*, 12*b* and 12*c* more particularly illustrate the operation of the rack-and-pinion mechanism in the food product holder of FIGS. 9-11.
Figure 12B:
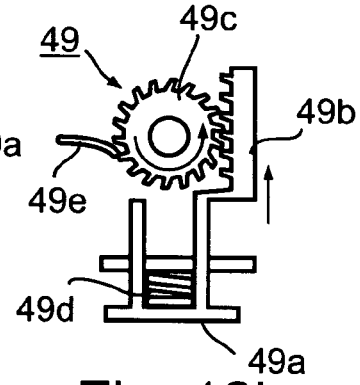
Figure 12C:
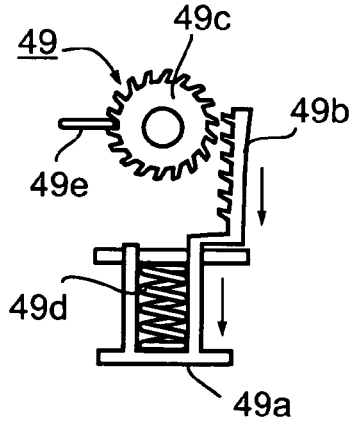

As illustrated particularly in FIGS. 11 and 12, rack-and-pinion mechanism 49 includes a finger piece 49*a* extending externally of housing 40 and coupled to a of rack bars 49*b* extending within the housing and engageable with a pinion 49*c* fixed to screw 45. Rack bar 49*b* is yieldable engageable with pinion 49*c* and is urged to its outermost position by a spring 49*d*. The arrangement is such that finger pressure applied to finger piece 49*a* drives rack bar 49*b* in one direction through a forward stroke, and upon release of the finger piece, the rack bar is driven through a return stroke by the spring 49*d*, as shown in FIGS. 12*a*-12*c*.

Rack-and-pinion mechanism 49 further includes a mechanical stop 49*c* (FIGS. 12*a*-12*c*), preventing reverse rotation of pinion 49*c*, thereby assuring that the operation of this mechanism will advance plunger 44 only in one direction, namely towards end wall 42 formed with dispensing openings 43.

Figure 14:
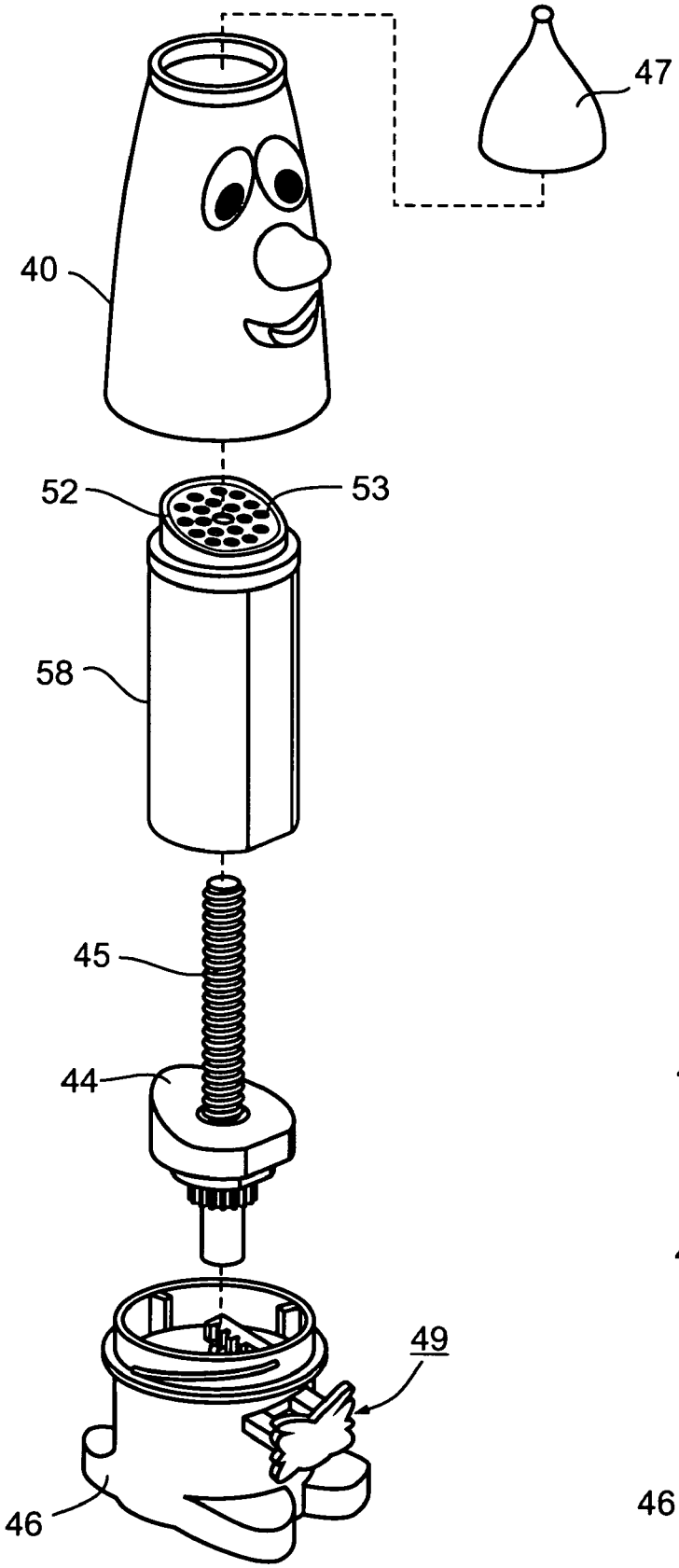
FIGS. 13-15 are views, corresponding to those of FIGS. 9-11, illustrating a modification in the construction of the food product holder.
Figure 13:
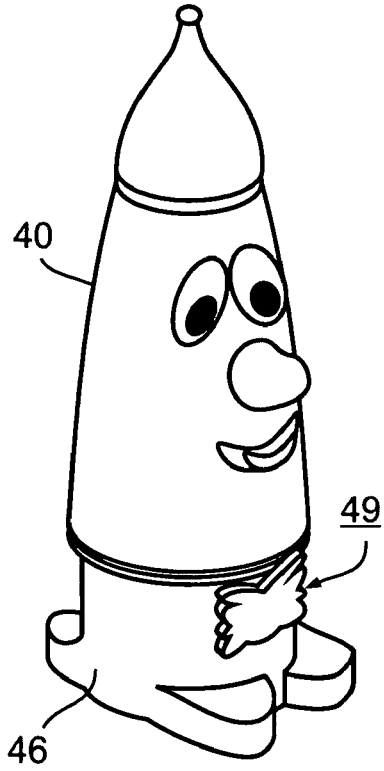
Figure 15:
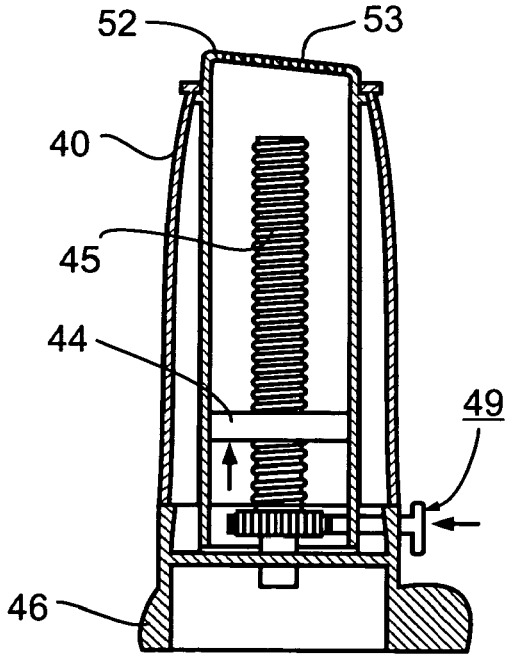

FIGS. 13-15 illustrate a food product holder which is basically of the same construction as described above with respect to FIGS. 9-12*c*, except that the end wall formed with the dispensing openings is fixed to the container containing the food product to be dispensed, as shown by end wall 52, dispensing openings 53 and container 58 in FIGS. 13-15. The other elements of the food product holder in FIGS. 13-15 are basically of the same construction, and therefore have been identified with the same reference numerals to facilitate understanding.

Figure 10:
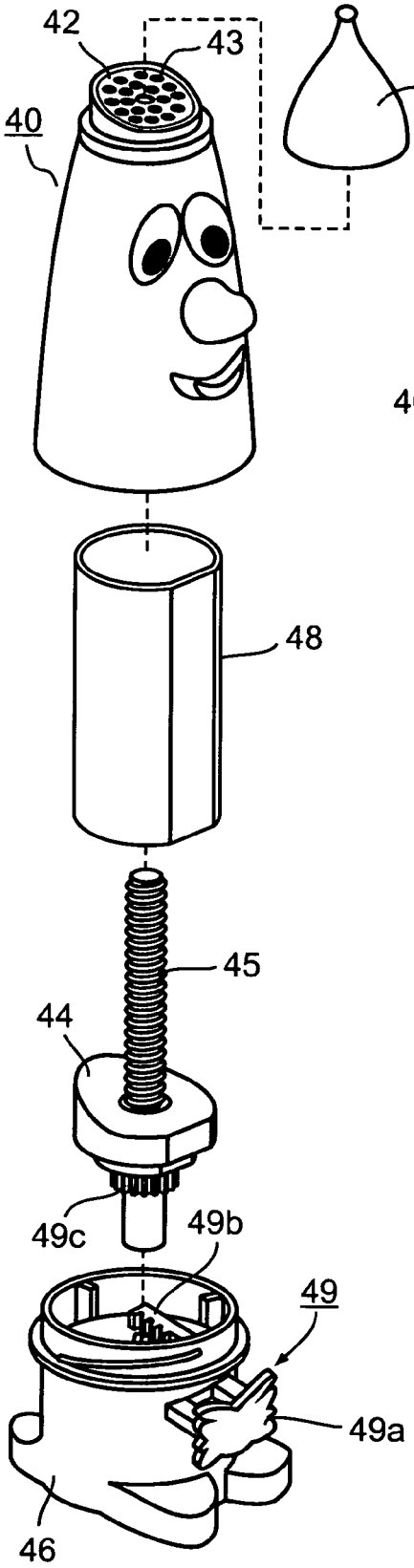
FIGS. 9-11 are views, corresponding to those of FIGS. 3-5, illustrating another construction of food product holder in accordance with the present invention.
Figure 9:
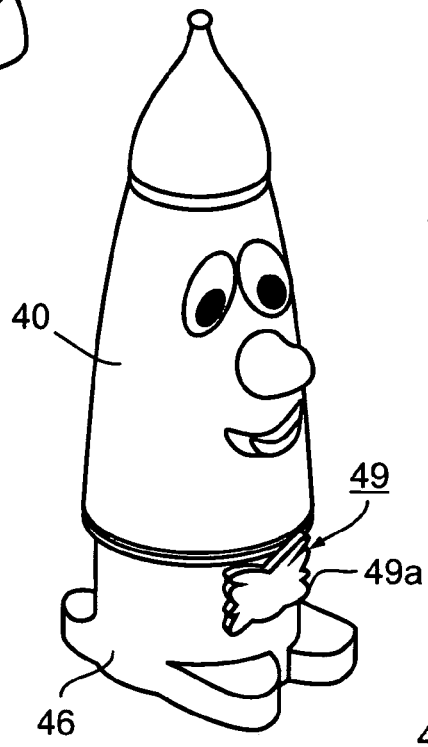
Figure 17:
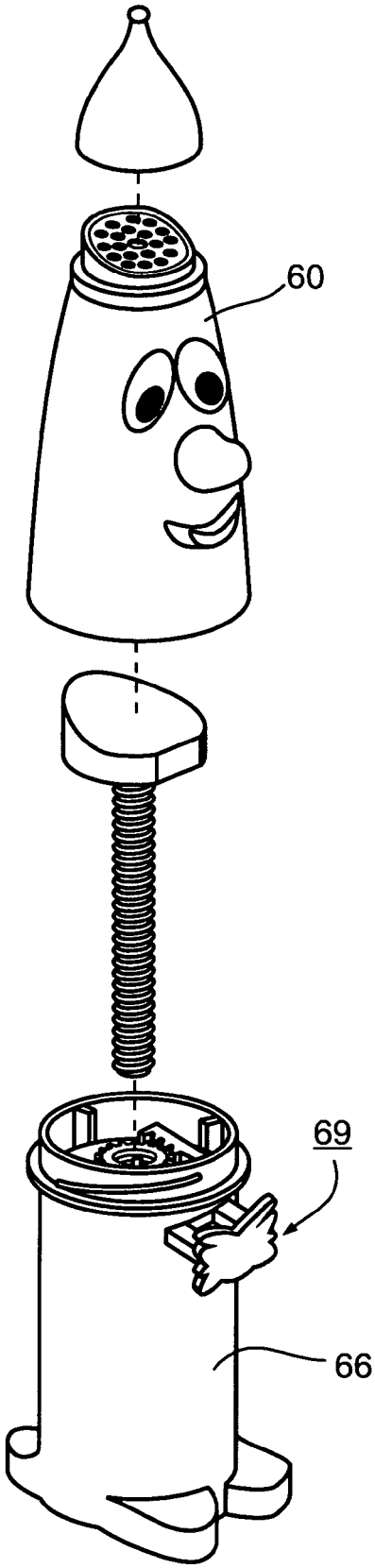
FIGS. 16-18 are views, corresponding to those of FIGS. 9-11, illustrating a further modification in the construction of the food product holder.
Figure 16:
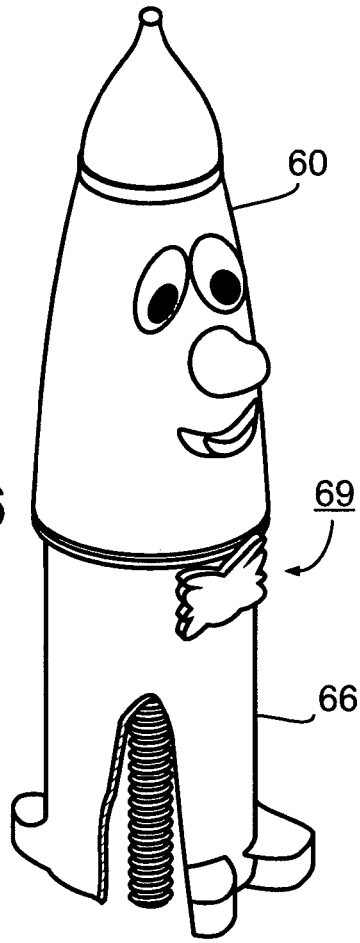
Figure 18:
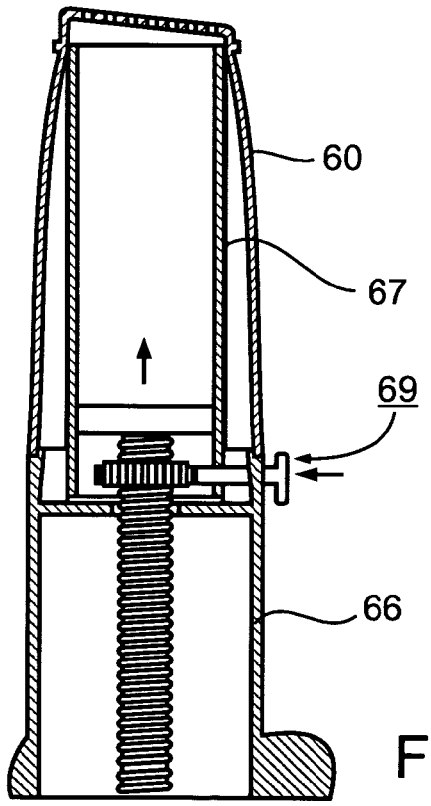

FIGS. 16-18 illustrate a food product holder also similar to that of FIGS. 9-11, but in this case the base, therein designated 66, is longer in length so as to enable more convenient holding of the food product holder, and more convenient operation of the rack-and-pinion mechanism, therein designated 69, for progressively feeding the food product through the dispensing openings. The outer housing 60 in the food product holder illustrated in FIGS. 16-18 is configured so as to enable the inner housing 68, when filled with the food product to be dispensed, to be introduced into the outer housing 60 from the bottom of the housing. A similar construction is provided in the previously-described holders.

Figure 20:
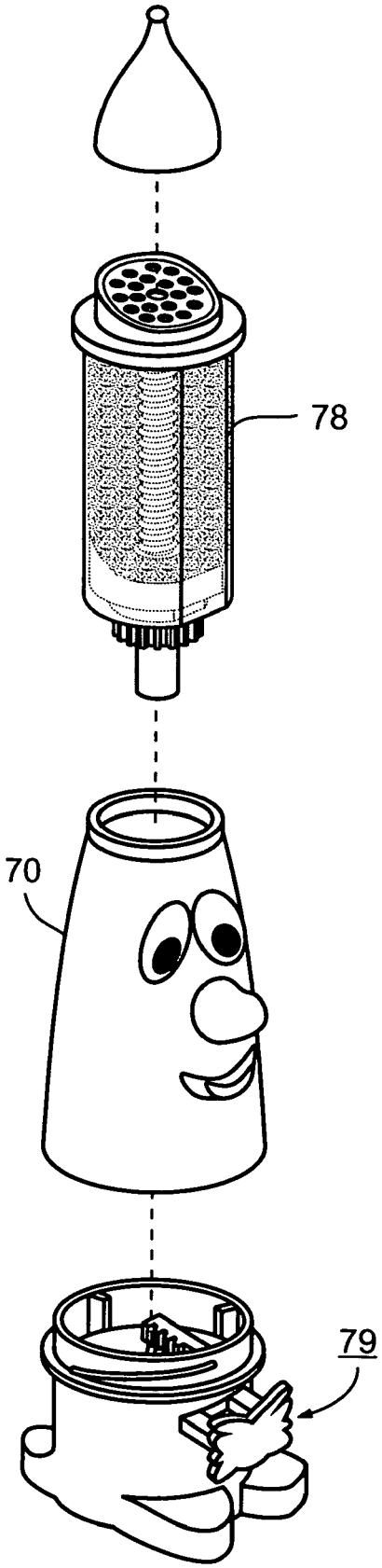
FIGS. 19-21 are views, corresponding to those of FIGS. 9-11, illustrating a still further modification in the construction of the food product holder.
Figure 19:
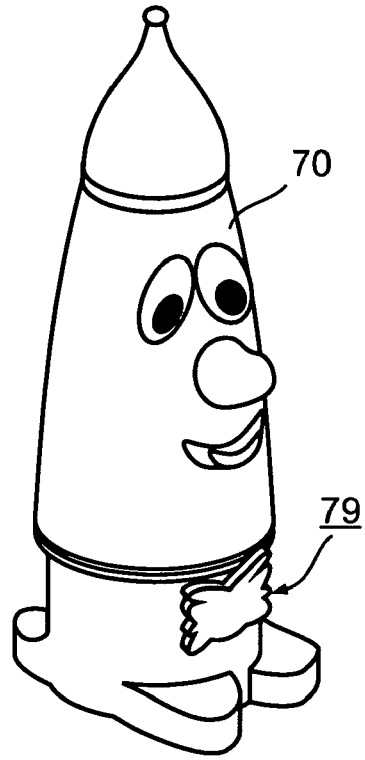
Figure 21:
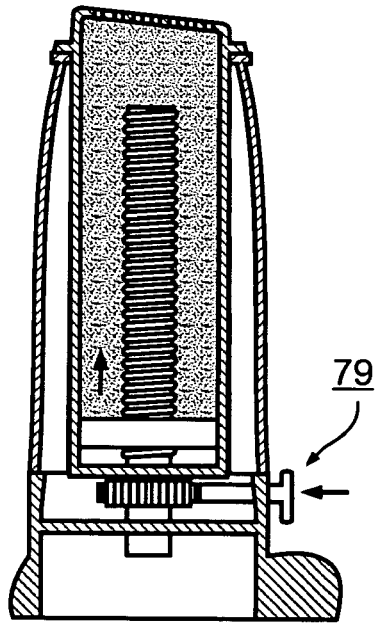

FIGS. 19-21 illustrate a food product holder of similar construction, except one permitting the housing 78, when pre-filled with the food product to be dispensed, to be introduced into the outer housing 70 from the top of the housing.

Figure 22:
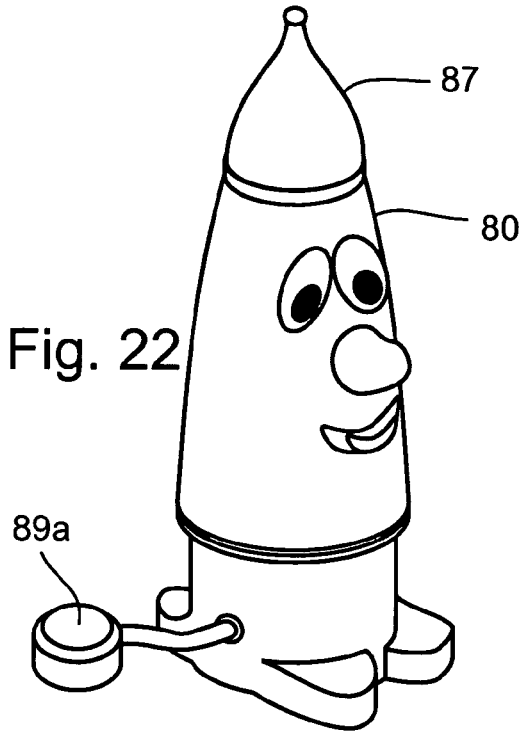
FIGS. 22-24 are views, corresponding to those of FIGS. 3-5, illustrating a still further construction of food product holder in accordance with the present invention.
Figure 24:
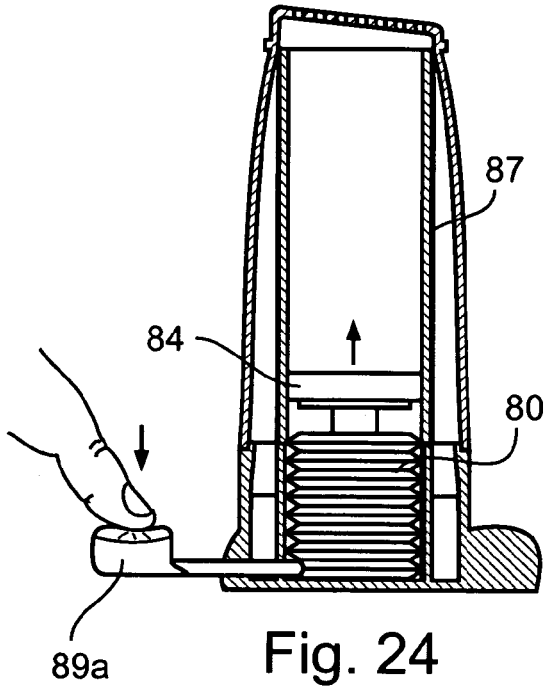
Figure 23:
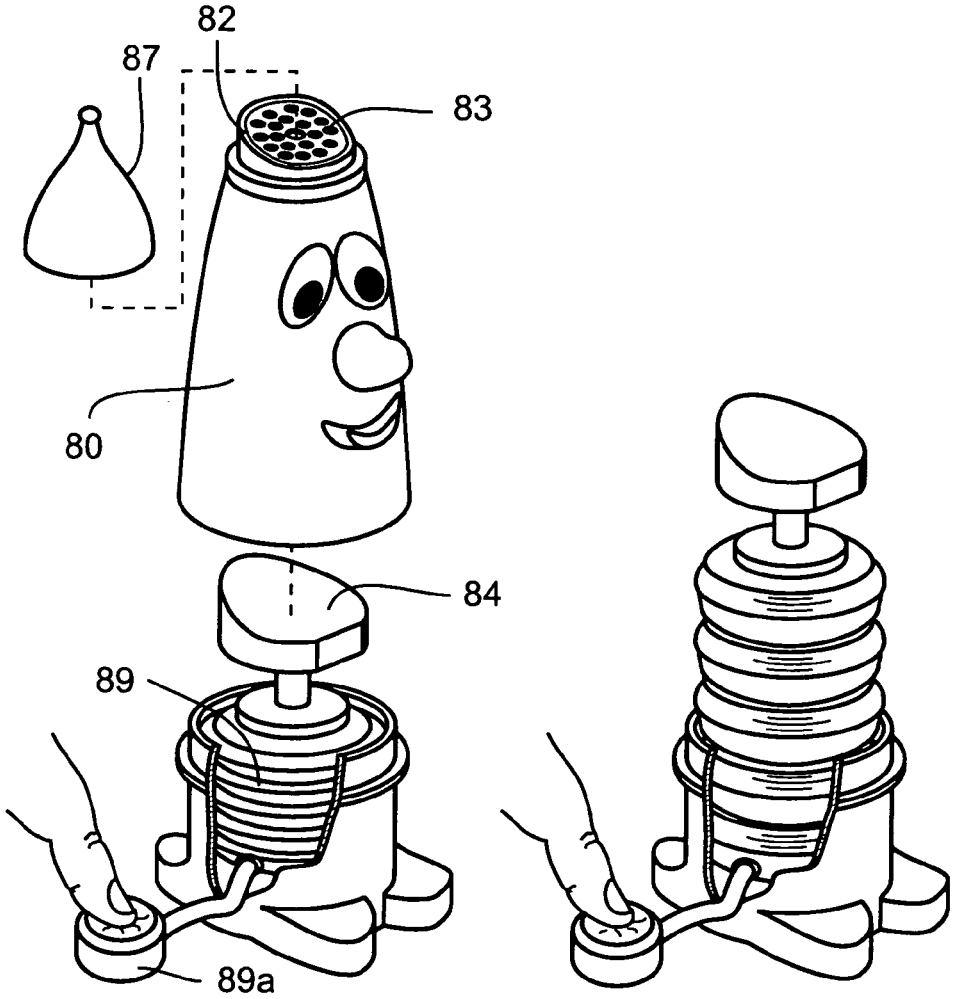

FIGS. 22-24 illustrate a food product holder of a substantially different construction. In this case, the outer housing 80, also configured to simulate a toy face, is also closed at one end by an end wall 82 formed with dispensing openings 83. It also includes a plunger 84 progressively moved by the user to progressively force the food product within the inner housing 88 through the dispensing openings 83 in end wall 82. In this case, however, plunger 84 is raised by an inflatable body 89 within the inner housing 88, which is inflated by hand pump 89*a* accessible externally of housing 80 such that the user may progressively feed the food product within the inner housing 88 through dispensing openings 83 by operating handpump 89*a* to progressively inflate the inflatable body 89.

Figure 26:
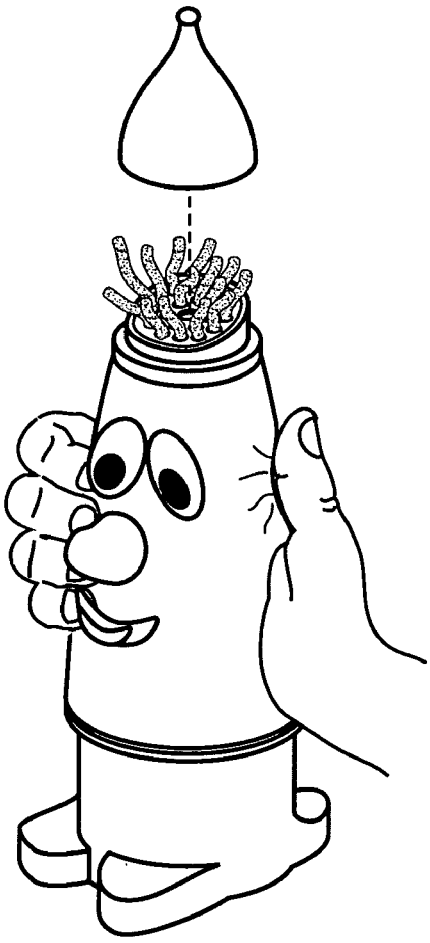
FIGS. 26 and 27 illustrate the manner of using the food product holder of FIG. 25.
Figure 25:
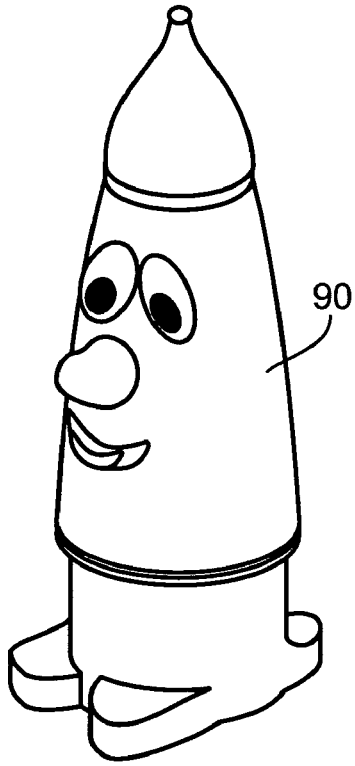
FIG. 25 illustrates another construction of food product holder in accordance with the present invention.
Figure 27:
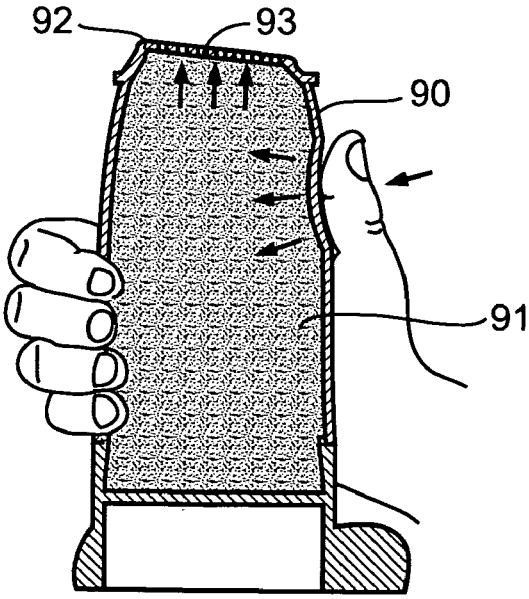

FIGS. 25-27 illustrate a further construction of food product holder, including an outer housing 90 defining an inner compartment 91 for the food product, e.g., ice-cream, to be held and dispensed via dispensing openings 93 formed in end wall 92. In this case, however, the outer housing 90 which is also shaped like a toy figure, is deformable by hand pressure, as shown particularly in FIGS. 26 and 27, to progressively squeeze the food product within chamber 91 out through dispensing openings 93.

Figure 29:
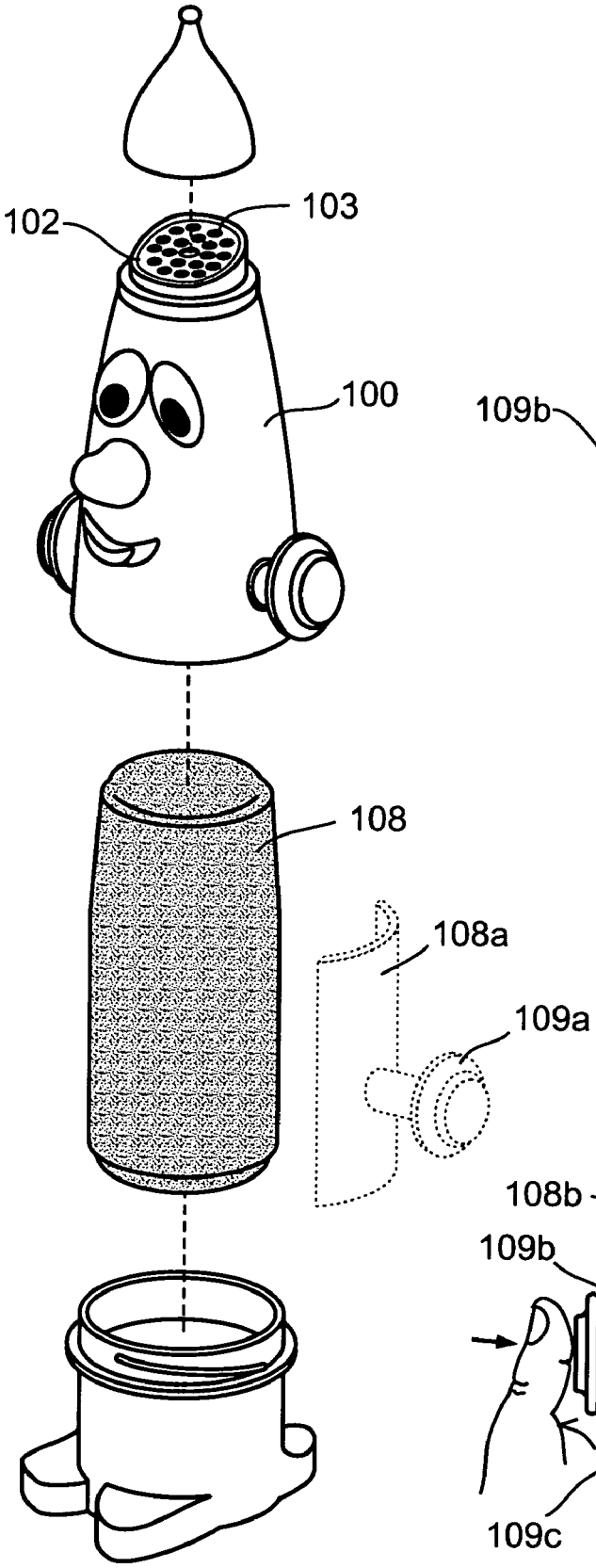
FIGS. 28-30 are views, corresponding to those of FIGS. 3-5, illustrating a further construction of food product holder in accordance with the present invention.
Figure 28:
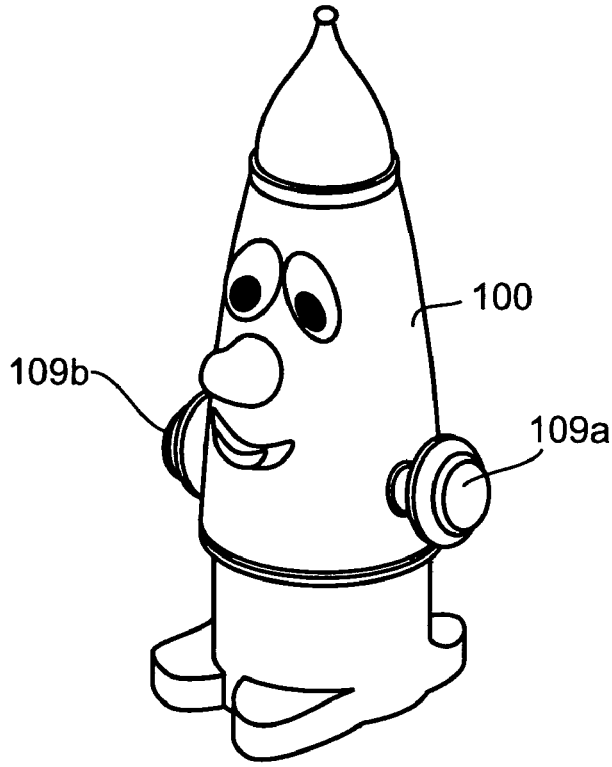
Figure 30:
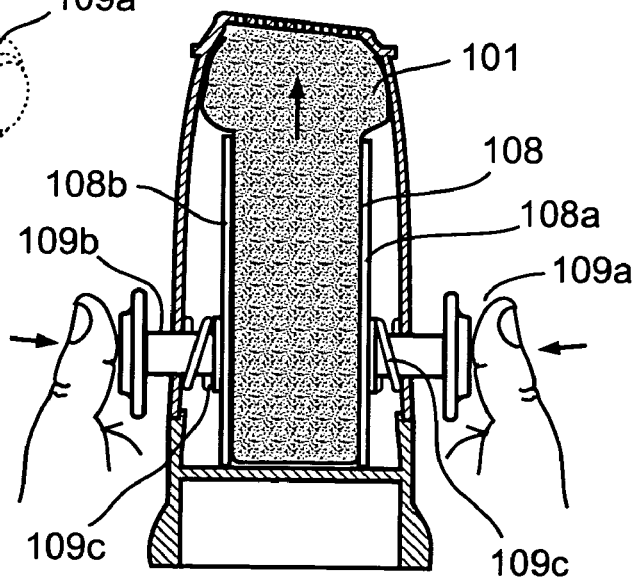
Figure 31:
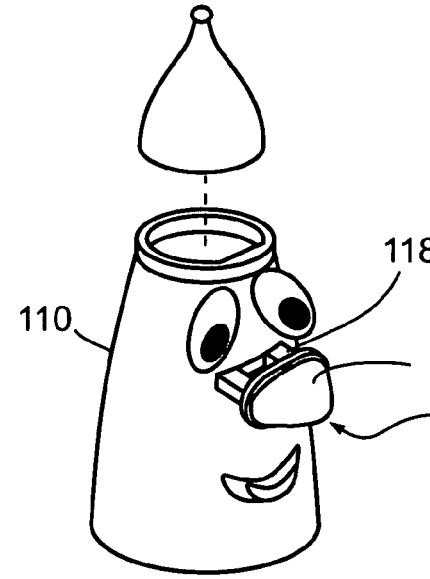
FIGS. 31-33 are views, corresponding to those of FIGS. 3-5, illustrating a still further construction of food product holder in accordance with the present invention.
Figure 31:
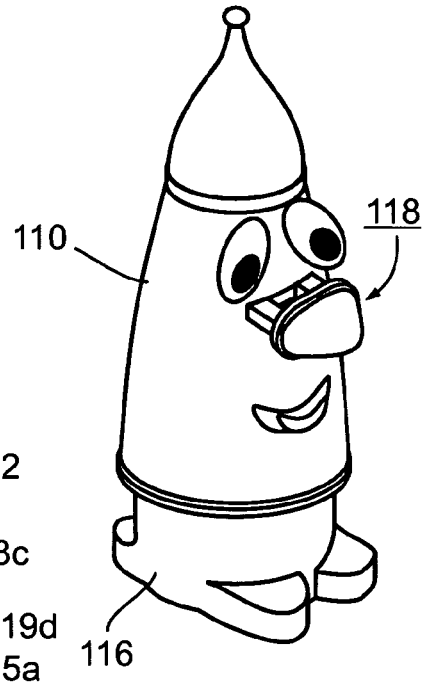
Figure 34:
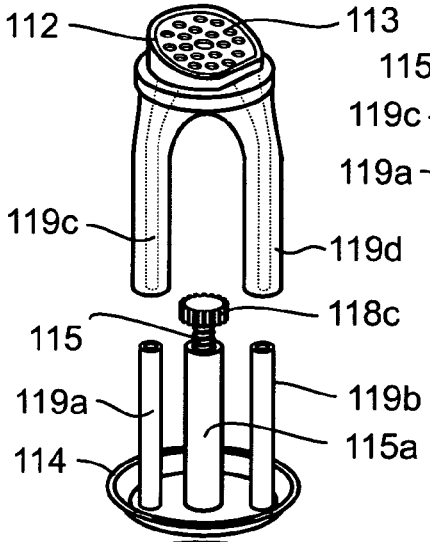
FIGS. 34 and 35 more particularly illustrate details of the food product holder of FIGS. 31-33.
Figure 34:
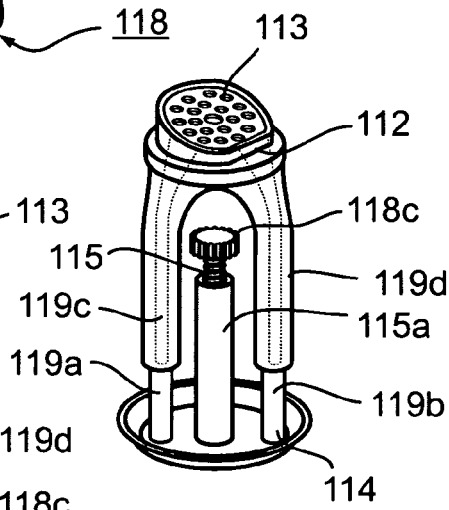
Figure 32:
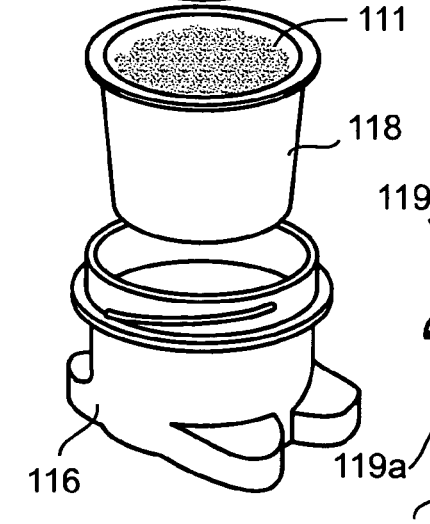
Figure 35:
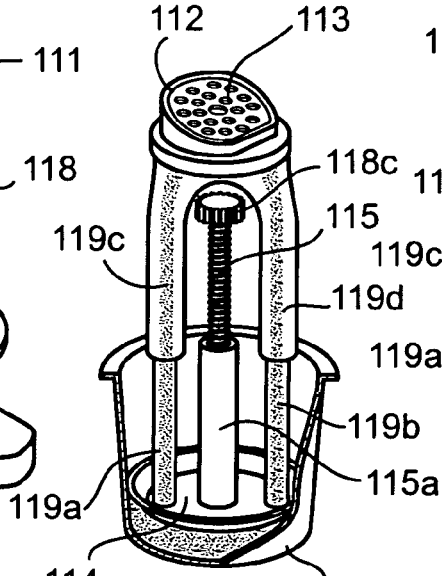
Figure 33:
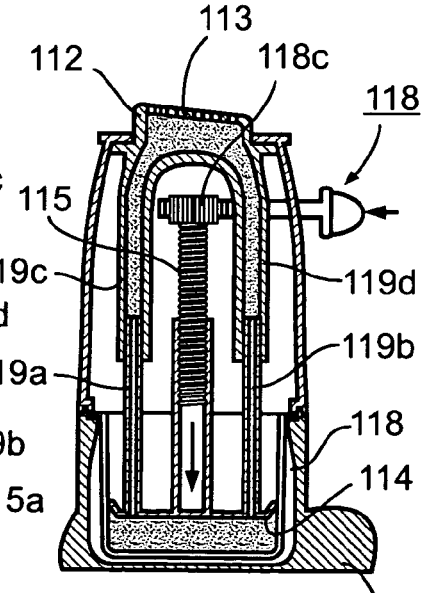

FIGS. 28-30 illustrates a food product holder including an outer housing 100 also having an inner compartment 101 closed by an end wall 102 formed with dispensing openings 103 enabling the user to progressively dispense the food product within the inner housing 108 via the dispensing openings 103. In this case, the inner housing 108 is deformable to progressively squeeze the food product in it through the dispensing openings 103. For this purpose, inner housing 108 containing the food product, (e.g., ice-cream) is engaged on its opposite sides by a pair of plates 109*a*, 109*b* each having a finger piece 109*c*, 109*d* projecting through an opening in the outer housing 100 to permit the two plates to be moved towards each other by squeezing finger pieces 109*c*, 109*d* towards each other against the action of springs 109*e*, 109*f*. This construction also particularly lends itself to providing the food product in a container 108 which can be quickly removed when the food product is depleted and replaced by another pre-filled container.

FIGS. 31-35 illustrate another construction of food product holder also adaptable for use with pre-filled containers of the food products to be dispensed, e.g., ice-cream. In this case, the holder also includes an outer housing 110 shaped in the form of a toy, attachable and detachable from a base 116 shaped to constitute the feet of the toy. The food product to be held and dispensed by the holder is contained within a container 117 in the form of a cup open at its top and introduced into the holder when the outer housing 110 is separated from the base 116.

Container 117, containing the food product to be dispensed, defines a compartment which can be progressively reduced in volume in order to force the food product therein through dispensing openings 113 formed in end wall 112 of housing 110. For this purpose, housing 110 includes a plunger 114 receivable within the open end of container 117 and progressively movable downwardly therein by a rack-and-pinion assembly, generally designated 118, to force the food product within container 117 through a pair of passages 119*a*, 119*b*, towards end wall 112 and through the dispensing openings 113 formed in that end wall. To accommodate the downward movement of plunger 114, while maintaining communication via passageways 119*a*, 119*b* to the dispensing openings 113, the two passageways 119*a*, 119*b* are in the form of tubes telescopically received within outer tubes 119*c*, 119*d*, integrally formed with end wall 112.

The rack-and-pinion assembly 118 thus progressively lowers plunger 114 within the food container 117, and thereby progressively feeds the food product within that container through the dispensing openings 113. Assembly 118 may be of a similar construction as described above with respect to FIGS. 9-12, to include the finger piece 118*a* for driving the rack bar 118*b* through forward and return strokes, respectively, in order to rotate pinion 118*c* in one direction. In this case, pinion 118*c* is secured to an end of a screw 15 received within an internally-threaded tube 115*a* fixed to the plunger 114. Thus, rotating pinion 118*c* drives, via tube 115*a*, plunger 114 downwardly within container 117, thereby forcing the food product, e.g., ice-cream, within that container upwardly through passageways 119*a*, 119*b* and through dispensing openings 113 in end wall 112.

In the holder illustrated in FIGS. 31-35, the finger piece 188*a* of the rack-and-pinion assembly 118 is configured to serve as the nose of the face simulated by the outer housing 110.

Figure 36:
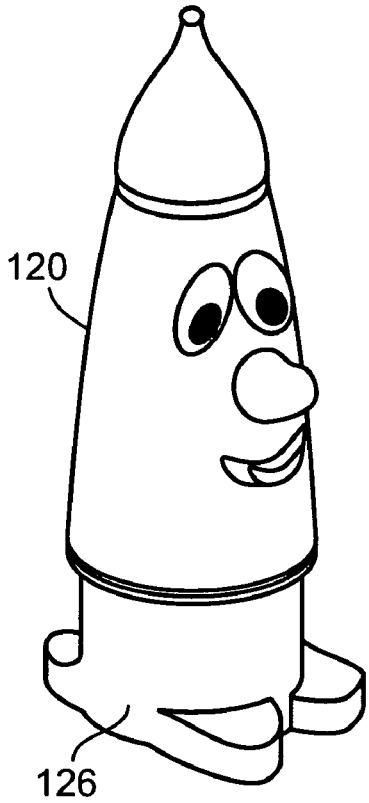
FIG. 36 illustrates a still further construction of food product holder in accordance with the present invention.
Figure 37:
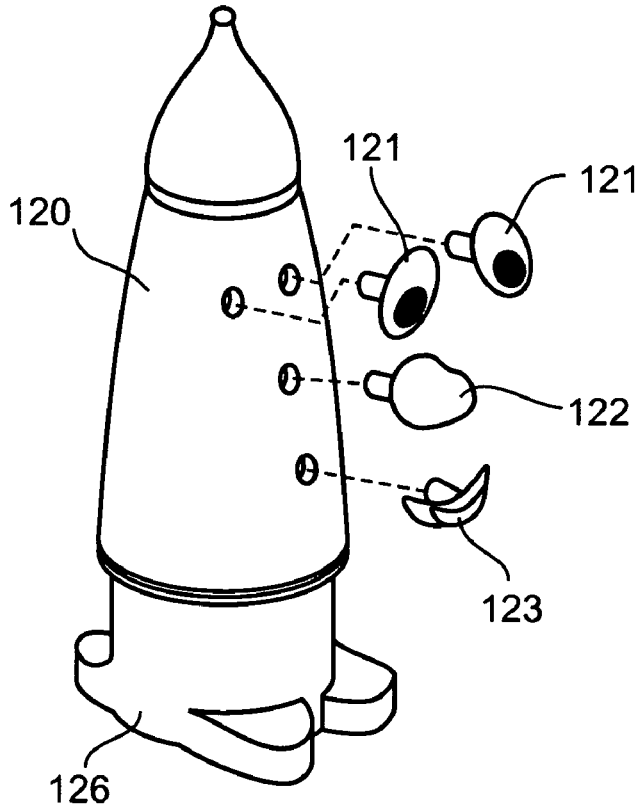
FIG. 37 illustrates a feature of the food product holder of FIG. 36.
Figure 38:
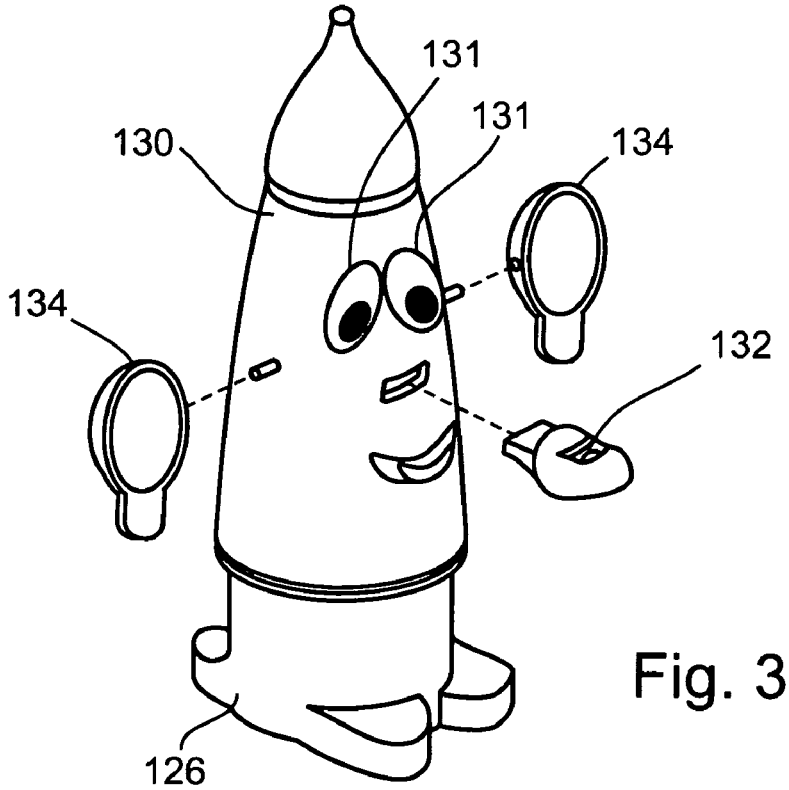
FIG. 38 illustrates a variation in the construction of the food product holder of FIGS. 36 and 37.
Figure 40:
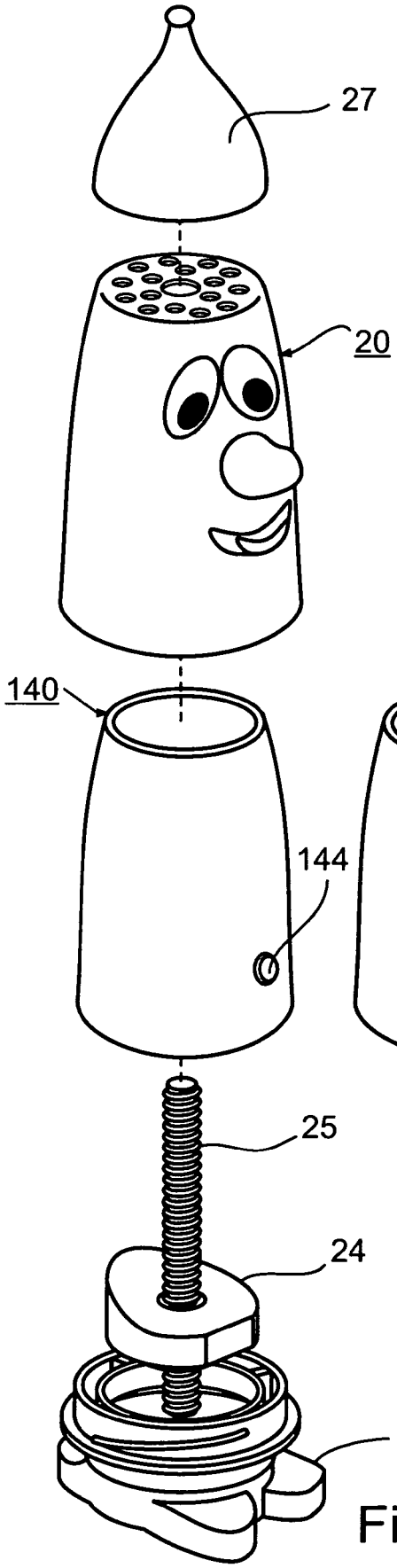
FIGS. 39-42 illustrate a food product holder similar to that of FIGS. 3-5 but including a modification in the construction of the interior food container.
Figure 42:
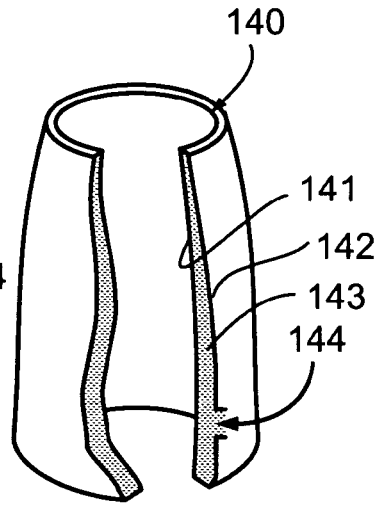
Figure 39:
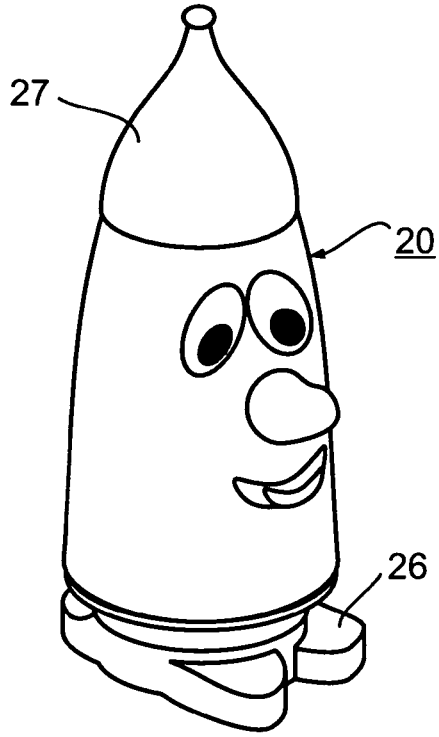
Figure 41:
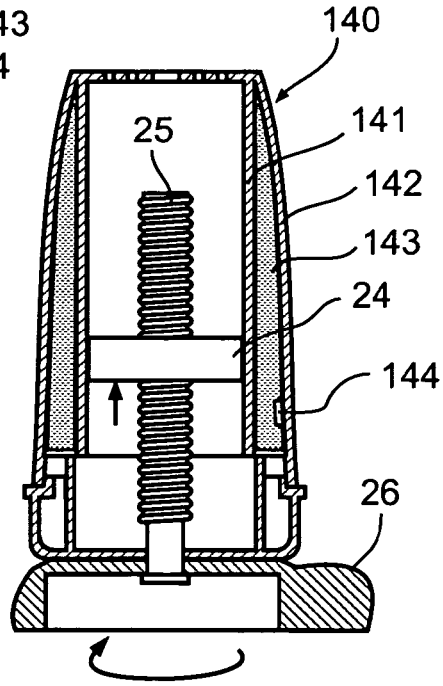

FIGS. 36-38 illustrate further features that may be provided in any of the toy configurations described above with respect to FIGS. 3-35. Thus, in the constructions illustrated in FIGS. 36-38, the outer housing 120 is also configured to simulate the shape of a toy having a face and feet for stably supporting the toy on a flat horizontal surface. In the construction illustrate in FIGS. 36 and 37, the simulated face includes a pair of eyes 121, a nose 122 and a mouth 123 all separately removably from the housing 120.

FIG. 38 illustrates a modification, wherein the housing, therein designated 130, further includes a pair of ears 134 which is also separately removable from the housing and shaped so as to serve as spoons for eating the food product dispensed from the housing. In the FIG. 38 modification, the simulated face further includes a removable nose 132 which may be designed so as to serve as a whistle or other form of noise maker.

FIGS. 39-42 illustrate a food product holder similar to that of FIGS. 3-5, but including an inner container 140 for containing the food product to be dispensed (not shown). Food container 140 is of a double-wall construction. It includes two spaced walls 141, 142, and a cooling or heating material 143 between them for cooling or heating the food article to be dispensed. For example, if the food article is ice-cream, or other food product normally eaten cold, the material 143 within container 140 would be in a solid state so as to absorb heat when it changes to a liquid state. On the other hand, if the food product to be dispensed is to be eaten warm (e.g., mashed potatoes), material 143 within the inner container 140 would be a heating material. Material 143, whether heating or cooling, is introduced via inlet 144 into the space between walls 141, 142 of container 140 in liquid form, and then either heated or cooled (frozen) when ready for use.

In all other respects, the food product holder illustrated in FIGS. 39-42 is constructed as described above with respect to FIGS. 3-5, and therefore corresponding reference numerals have been used to identify its parts.

Although the invention has been described in conjunction with specific embodiments thereof, it is evident that many alternatives, modifications and variations will be apparent to those skilled in the art. For example, instead of holding and dispensing ice-cream or other relatively soft foods, the pressure-flowable material held and dispensed could be a liquid refreshment, a liquid medication, or the like. Accordingly, it is intended to embrace all such alternatives, modifications and variations that fall within the spirit and broad scope of the appended claims. All publications, patents, patent applications and sequences identified by their accession numbers mentioned in this specification are herein incorporated in their entirety by reference into the specification, to the same extent as if each individual publication patent, patent application or sequence identified by their accession number was specifically and individually indicated to be incorporated herein by reference. In addition, citation or identification of any reference in this application shall not be construed as an admission that such reference is available as prior art to the present invention.

What is claimed is:

1. A holder for enabling a user to hold and to dispense a Pressure-flowable product, comprising:

a housing having an internal compartment for the pressure-flowable product;

one end of said housing being closed by an end wall formed with at least one dispensing opening for dispensing said pressure-flowable product;

said housing being shaped like a toy figure so as to be attractive to children, and including a flat base shaped to simulate the feet of the toy figure and to permit the housing to stably rest on a flat horizontal surface the feet-shaped flat base being rotatable with respect to the housing and being coupled to the housing such that rotation of the feet-shaped flat base by a user causes the volume of said compartment to be progressively decreased by the user to progressively force the pressure-flowable product within said compartment through said dispensing opening in the end wall of the housing.

2. The holder according to claim 1, wherein said housing includes:

a rotatable screw extending axially in said compartment and having an outer end coupled to said feet-shaped flat base so as to be rotatable therewith; and a plunger extending transversely in said compartment to define the end of the compartment opposite to that of said dispensing opening; said plunger being cooperable with the opposite end of said screw such that rotation of the screw by the feet-shaped flat base in one direction advances said plunger within said compartment to decrease the volume of said compartment and thereby to force the pressure-flowable product therein through said dispensing opening of the housing.

3. The holder according to claim 2, wherein said plunger is fixed to said screw, and said screw is threadeadly received in said housing.

4. The holder according to claim 1 wherein said pressure-flowable product is contained in a container which is constructed such that, when filled with the product, the container is introducible into said housing, and when emptied, it is removable from the housing for replacement by another filled container.

* * * * *